US005219136A

United States Patent [19]

Hassel et al.

[11] Patent Number: 5,219,136

[45] Date of Patent: Jun. 15, 1993

[54] ADJUSTABLE KEYBOARD SUPPORT

[75] Inventors: H. Charles Hassel, Los Angeles; Jeff A. Wielt, Lakewood, both of Calif.

[73] Assignee: MicroComputer Accessories, Inc., Los Angeles, Calif.

[21] Appl. No.: 754,335

[22] Filed: Sep. 4, 1991

[51] Int. Cl.[5] ..... B68G 5/00

[52] U.S. Cl. ..... 248/118; 248/918

[58] Field of Search ..... 248/118, 918, 118.3, 248/118.1, 118.5; 400/715

[56] References Cited

U.S. PATENT DOCUMENTS

| | | | |
|---|---|---|---|
| 367,309 | 7/1887 | Meredith . | |
| 1,135,155 | 4/1915 | Blundell . | |
| 1,277,169 | 9/1918 | Anderson . | |
| 2,950,890 | 9/1960 | Hough, Jr. | 248/118 |
| 3,300,250 | 1/1967 | Dollgener et al. | 297/411 |
| 4,129,746 | 12/1978 | Lambden | 178/18 |
| 4,316,082 | 2/1982 | Fritz | 235/146 |
| 4,481,556 | 11/1984 | Berke et al. | 361/222 |
| 4,482,063 | 11/1984 | Berke et al. | 211/69.1 |
| 4,482,064 | 11/1984 | Berke et al. | 211/69.1 |
| 4,496,200 | 1/1985 | Hagstrom et al. | 312/208 |
| 4,511,111 | 4/1985 | Godfrey et al. | 248/495 |
| 4,545,554 | 10/1985 | Latino et al. | 249/118.1 |
| 4,621,781 | 11/1986 | Springer | 248/118 |
| 4,688,862 | 9/1987 | Fowler et al. | 312/325 |
| 4,776,284 | 10/1988 | McIntosh | 108/138 |
| 4,901,972 | 2/1990 | Judd et al. | 248/918 |
| 4,913,390 | 4/1990 | Berke | 248/176 |
| 4,973,176 | 11/1990 | Dietrich | 400/715 |
| 4,976,407 | 12/1990 | Schwartz et al. | 312/208 |
| 5,058,840 | 10/1991 | Moss et al. | 400/715 |

FOREIGN PATENT DOCUMENTS 8900111 1/1989 PCT Int'l Appl. .

OTHER PUBLICATIONS

"PC Center TM" Brochure, pp. 79-80.
"Workstation Accessories" Brochure, p. A101.
"Keyboard Drawers" Brochure, p. 102A.
"Global Handistation" Brochure p. 143.
"'Classic' PC Workstation" Brochure, p. 144.
"Microcenter", Brochure, 2 pages.
"Wrist Pro TM", Brochure, 2 pages.

*Primary Examiner*—Blair M. Johnson
*Attorney, Agent, or Firm*—Price, Gess & Ubell

[57] ABSTRACT

A wrist and keyboard support assembly that may be linearly and angularly adjusted in a variety of dimensions. The wrist and keyboard support assembly includes a keyboard platform and a variable height wrist support assembly. The wrist support assembly may be variably distanced from the keyboard platform to accommodate various sized keyboards. The wrist support assembly includes a wrist bar that may be adjusted to various heights relative to the work surface or the keyboard supported on the keyboard platform. The angle of the keyboard platform relative to the work surface may be adjusted to any desired angle.

10 Claims, 5 Drawing Sheets

ADJUSTABLE KEYBOARD SUPPORT

BACKGROUND OF THE INVENTION

1. Field of the Invention

The present invention relates generally to desk accessories and, more particularly, to an adjustable wrist and keyboard support which may be interposed between a work surface and a keyboard and may be adjusted in height, front-to-back depth, and angle relative to the work surface.

2. Description of Related Art

Various types of keyboard supports have been developed to help the keyboard operator be more comfortable and, therefore, more productive.

The simplest wrist support device is comprised of an elongated rectangular wrist cushion that may be placed on the work surface in front of the keyboard which rests directly on top of the work surface. The problem with this type of device is that the keyboard and wrist rest cushion may become separated in use. Moreover, many keyboards include rear pop-out legs to support the keyboard at a single fixed angle relative to the work surface. The predetermined angle is often too steep or not steep enough for the personal preference of the typist. An adjustable wrist bar is disclosed in U.S. Pat. No. 4,973,176.

More complicated devices integrate a wrist support with a keyboard support. Such hybrid devices typically include a planar keyboard platform and some type of wrist support at a front edge of the keyboard platform. Many of the hybrid devices include a wrist support that is at a fixed height relative to the work surface and an upper surface of the keyboard. Examples of hybrid devices having fixed-height wrist supports are disclosed in U.S. Pat. Nos. 4,481,556, 4,482,063, and 4,482,064.

Hybrid devices having an adjustable height wrist bar have also been proposed. For example, U.S. Pat. No. 4,545,554 discloses a keyboard support having a planar keyboard platform and a wrist support bar that may be adjusted up or down by turning a pair of threaded knobs integrated with the wrist bar.

In some computer work stations, the keyboard is stored in a drawer located beneath the work surface, rather than directly on the work surface. The hybrid drawer typically includes an integral wrist support bar. The keyboard operator pulls the drawer and keyboard out into a working position and pushes the drawer and keyboard in for storage. An example of a keyboard drawer having an integral fixed-height wrist support is disclosed in FIG. 5 of U.S. Pat. No. 4,688,862. Although the foregoing work station conveniently allows the keyboard to be moved out of the way when not in use, there is no accommodation for an adjustable wrist bar for the keyboard, nor can the angle of the keyboard relative to the work surface be adjusted.

Another device for easing keyboard strain is comprised of an elongated wrist support at a top surface thereof and a stair step configuration on a back side thereof. The front edge of the keyboard is placed on a desired one of the steps, thereby adjusting the distance between the wrist support bar and the top surface of the keyboard. The height of the wrist support bar relative to the work surface is fixed. It is only the height between the user's fixed-height wrist and the top of the keyboard that may be varied. Moreover, this hybrid may fall off of the stair steps during use. Finally, the angle of the keyboard is inherently varied downward and away from the user as the front edge of the keyboard is placed on successively higher steps. Thus, there is no way of achieving both a desired keyboard angle and a desired height between the user's wrist and the top of the keyboard.

Another device is comprised of a horizontal planar section that is typically interposed between the work surface and the CPU housing or the monitor. The horizontal planar section supports a keyboard platform that extends at an angle from the edge of the work surface. A lip is typically present at a bottommost end of the keyboard platform to retain the keyboard on the incline. The foregoing device supports the keyboard at a fixed angle only, offers no wrist support whatsoever, and supports the keyboard in an inconvenient location.

SUMMARY OF THE INVENTION

It is an object of the present invention to provide an adjustable keyboard support that overcomes the problems associated with the conventional keyboard support apparatus.

In particular, it is an object of the present invention to provide an adjustable keyboard support that will support a keyboard at a variable angle relative to the work surface;

It is a further object of the present invention to provide an adjustable keyboard support that can support a user's wrist at a variable height relative to a front end thereof;

It is a further object of the present invention to provide an adjustable keyboard support that is adjustable in front-to-back depth to accommodate a variety of keyboard sizes;

It is a further object of the present invention to provide a keyboard support that will securely maintain the keyboard adjacent to the wrist support assembly; and It is a further object of the present invention to provide a keyboard support that may be adjusted in the vertical dimension, horizontal dimension, and also angularly relative to the work surface.

The present invention achieves the above objects by providing an adjustable keyboard support that comprises a keyboard platform and a wrist support bar. The wrist support bar is attached at a variable distance from a front edge of the keyboard platform in order to accommodate various sized keyboards. Moreover, the height of the wrist support assembly is adjustable to allow a user to set a desired height relative to the work surface, the keyboard, or both.

In the preferred embodiment, the adjustable keyboard support is carried on the work surface by three support members in a tripod fashion. The support members include left and right members located beneath the wrist support assembly and a rear support member located near a back edge of the keyboard platform. In the preferred embodiment, the angle of the keyboard platform relative to the work surface may be adjusted by varying the height of the rear support member.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an adjustable keyboard support assembly.

Figure 1:
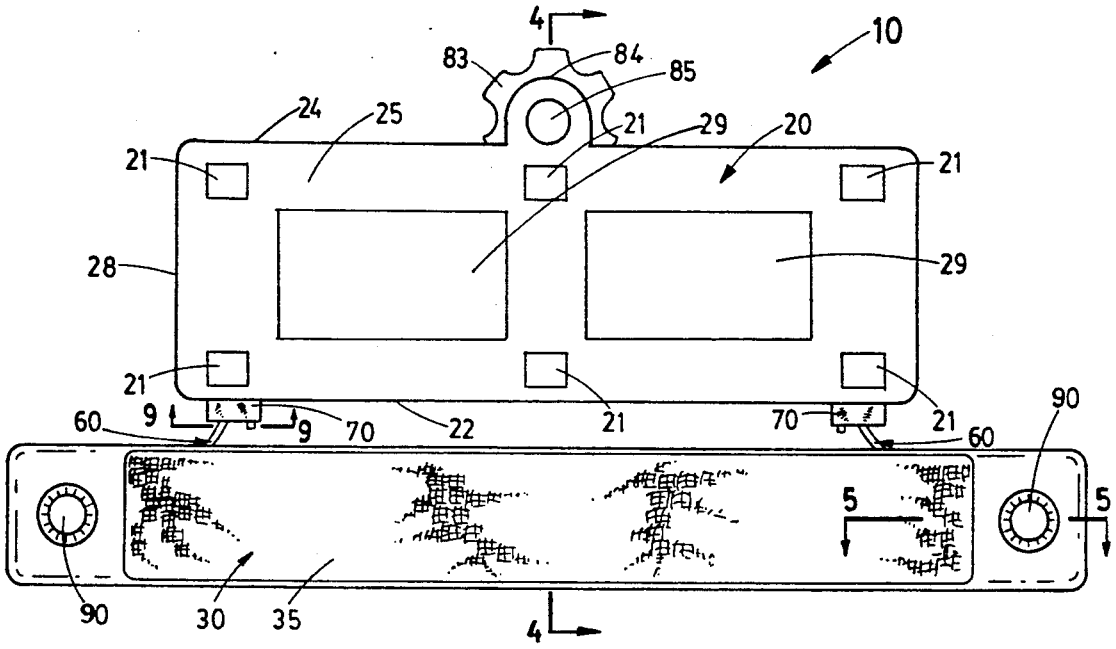
FIG. 1 is a top plan view of a preferred keyboard support assembly according to the present invention.
Figure 2:
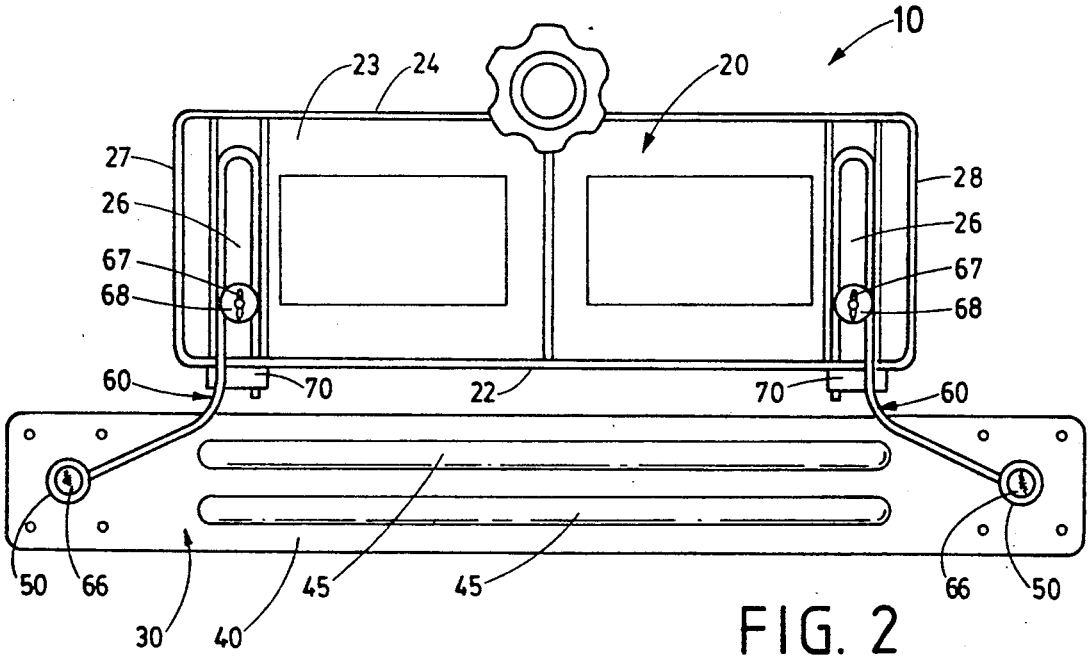
FIG. 2 is a bottom plan view of the preferred keyboard support assembly.

FIGS. 1 and 2 illustrate a preferred embodiment of an adjustable keyboard support assembly 10 according to the present invention which is comprised of a keyboard platform 20 and a wrist support assembly 30. The wrist support assembly 30 is adjustably attached to the keyboard platform 20 with a pair of rigid support rods 60 that may be slidably positioned relative to the keyboard platform 20.

Figure 3:
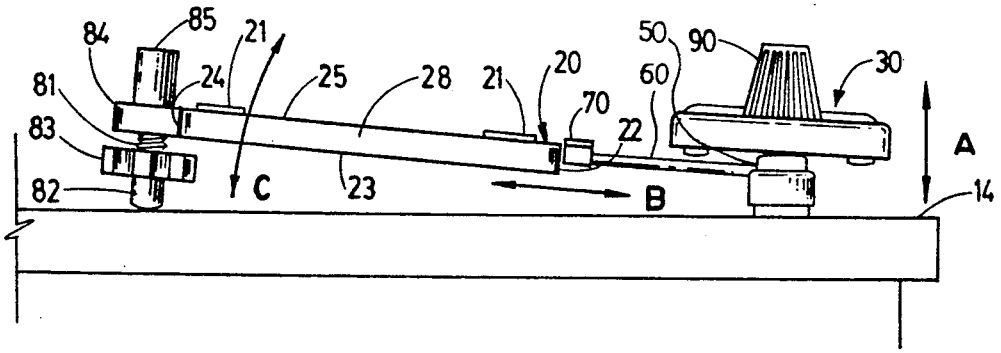
FIG. 3 is a left elevational view of the preferred keyboard assembly.
Figure 4:
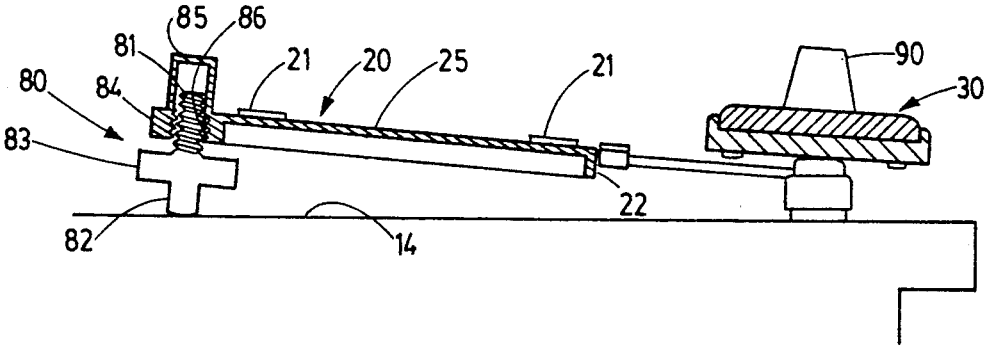
FIG. 4 is a cross-sectional view of the preferred keyboard assembly of FIG. 1 taken along section lines 4—4.
Figure 8:
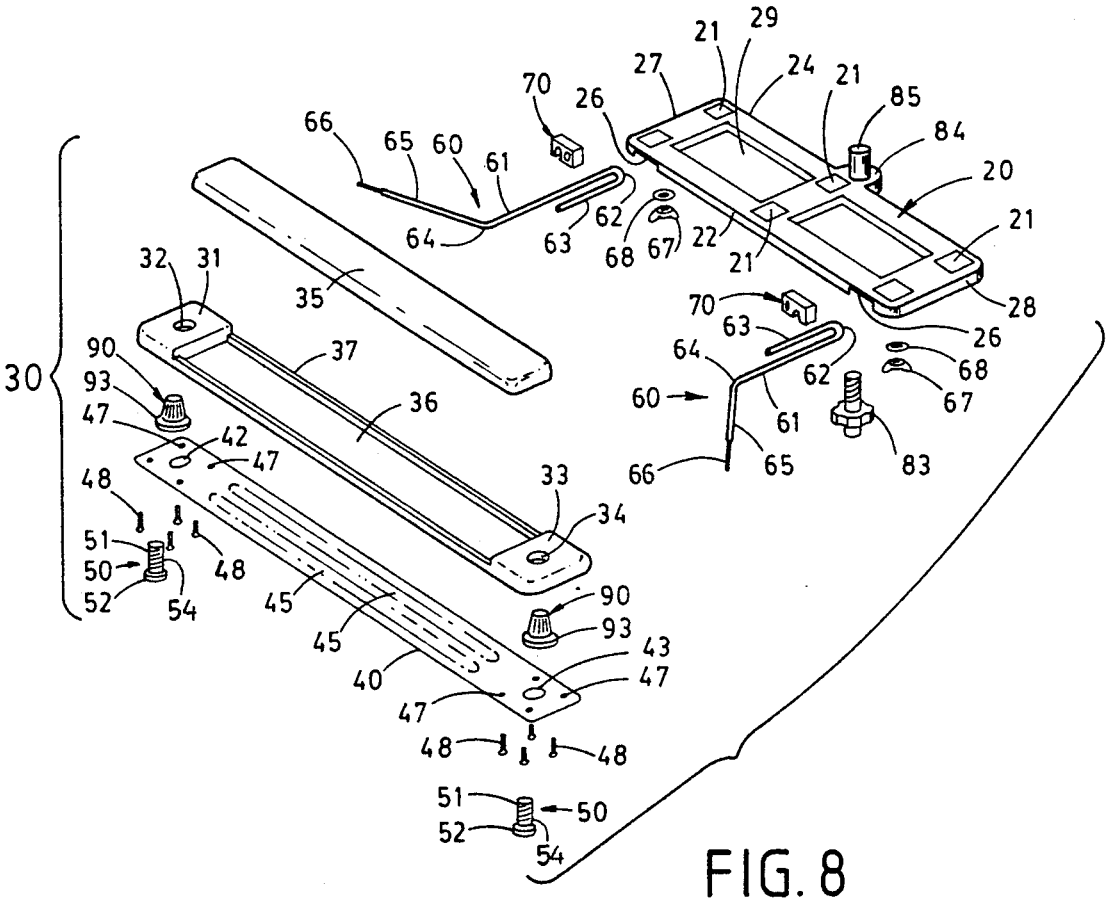
FIG. 8 is an exploded perspective view of the preferred keyboard assembly.

The preferred keyboard platform 20 is substantially rectangular in shape, having a bottom 23 and a substantially planar top 25. The keyboard platform 20 may be formed of any of a variety of materials, but is preferably formed of plastic from a conventional molding process. In order to minimize weight and the amount of material, the keyboard platform 20 preferably carries a plurality of large open areas 29. The bottom 23 is substantially concave and defined by a peripheral skirt which defines a front edge 22, a back edge 24, a left edge 28, and a right edge 27. As shown in FIGS. 1 and 3, for example, a plurality of antislip pads 21 may be secured to the top 25 of the keyboard platform 20. A pair of spaced slide channels 26 are defined in the front edge 22 and the bottom 23, as shown in FIGS. 2 and 8. The operation of the spaced slide channels 26 will be described further herein.

The preferred wrist support assembly 30 is best understood with reference to the exploded view of FIG. 8. The wrist support assembly 30 is comprised of an elongate member 37, a wrist pad 35, a retainer plate 40, a pair of knobs 90, and a pair of front support members 50.

The elongate member 37 has a left end 31 and a right end 33. A pair of apertures 32, 34 are defined in the left and right ends 31, 33, respectively. As best shown in the cross-sectional view of FIG. 5, each of the apertures 32, 33 is bounded by an annular recess 38 on an underside of the elongated member 37. The wrist pad 35 is made, for example, of fabric covered foam. The elongated member 37 includes a depression 36 located between the left and right ends 31, 33 for carrying the wrist pad 35.

Figure 5:
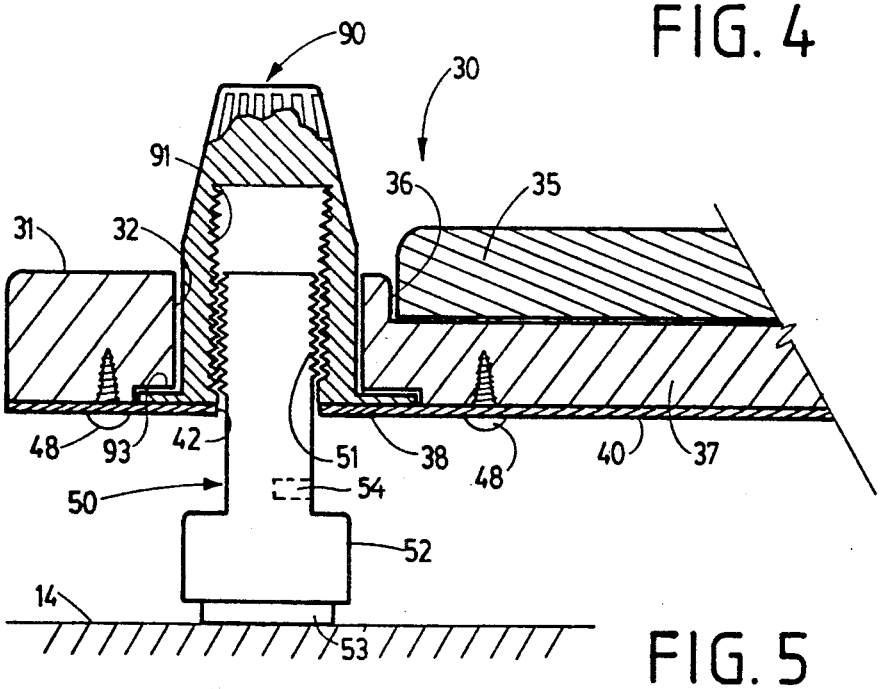
FIG. 5 is a cross-sectional view of the preferred keyboard assembly of FIG. 1 taken along section lines 5—5.
Figure 6:
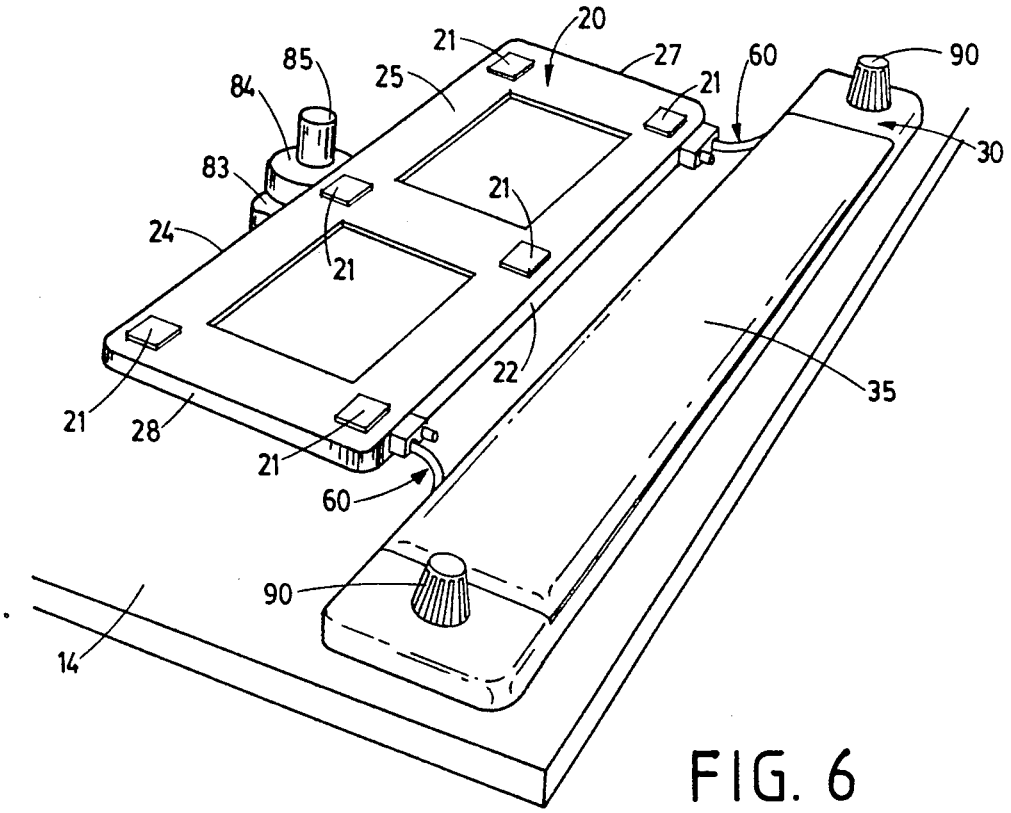
FIG. 6 is a perspective view of the preferred keyboard assembly.
Figure 7:
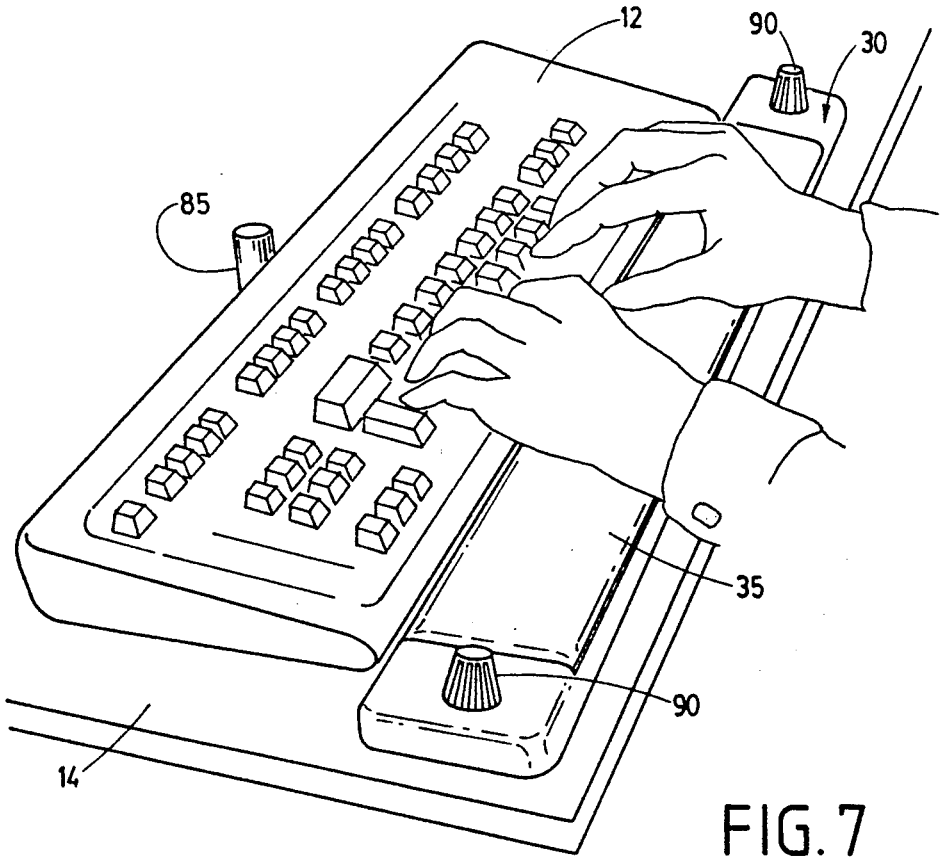
FIG. 7 is a perspective view of the preferred keyboard assembly with a keyboard located thereon.

The knobs 90 protrude through corresponding apertures 32, 34 in the elongate member 37. Each knob 90 includes a shoulder 93 for engaging the annular recess 38 as shown in FIG. 5. The knobs 90 are rotatably secured in the apertures 32, 34 by the retainer plate 40. The depth of the annular recess 38 must be sufficient to allow the shoulders 93 to rotate freely between the elongate member 37 and the retainer plate 40. The retainer plate 40 may be fastened to an underside of the elongated member with any variety of fastening means. The preferred fastening means is a plurality of screws 48 which extend into the substance of the elongated member 37 through a plurality of apertures 47 in the retainer plate 40. The retainer plate 40 may also include a plurality of elongated depressions 45 to increase its rigidity.

The rigid support rods 60 are preferably formed from a steel rod of approximately 3/16-inch diameter. Each rigid support rod 60 is comprised of a main section 61. A U-bend 62 at a back end of the main section 61 supports a shorter adjacent section 63 that extends from the U-bend 62 parallel to the first section 61. An obtuse bend 64 at a front end of the main section 61 supports a front section 65 that extends from the main section 61 at an obtuse angle. The front section 65 has a threaded front end 66.

The back ends of the rigid support rods 60 are carried by the spaced slide channels 26 that extend backward from the front edge 22 and along the bottom 23 of the keyboard platform 20 (see FIG. 2). As suggested by arrow "B" of FIG. 3, the rigid support rods 60 may be variably positioned in the spaced slide channels 26 as desired. FIG. 2 shows that the rigid support rods 60 may be secured in the desired position by tightening the rigid support rods 60 against a bottom surface of the spaced slide channels 26 with wing nuts 67 and washers 68.

As shown in FIG. 2, the threaded end 66 of each rigid support rod 60 is threaded into a side hole 54 on a front support member 50. Each support member 50 is comprised of an upwardly-extending threaded cylindrical portion 51 and a support foot 52. As shown in FIG. 5, the support foot 52 may also carry an antifriction pad 53 to prevent the adjustable keyboard support assembly 10 from sliding on or marring the work surface 14. Each upwardly-extending threaded cylindrical portion 51 extends through a respective aperture 42, 43 defined in the retainer plate 40 to engage a threaded aperture 91 of a corresponding knob 90. By rotating the knob 90 clockwise or counterclockwise as desired, the height of the wrist support assembly 30 relative to the work surface 14 may be adjusted as desired.

Figure 9:
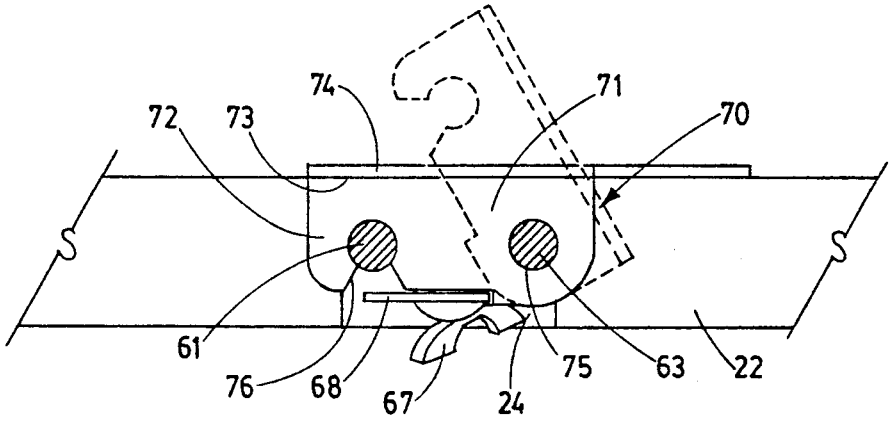
FIG. 9 is a cross-sectional view taken along section lines 9—9 of FIG. 1, showing the operation of a bridging member.

A pair of bridge members 70 are attached to each rigid support rod 60 to add additional rigidity and to inhibit twisting. As best shown by the cross-section of FIG. 9, each bridge member 70 is comprised of a main body 71 and a finger 72. An aperture 75 is located in the main body 71. The aperture 75 may be slid over an exposed end of the shorter adjacent section 63 of the rigid support rods 60 and pivot thereon, as suggested by broken lines of FIG. 9. An open-sided aperture 76 is defined between the fingers 72 and the main body 71. After the bridge member 70 has been slid onto the shorter adjacent section 63, the bridge member 70 may be pivoted until the open-sided aperture 76 clicks onto the main section 61. The bridge member 70 serves to minimize any movement between the main section 61 and the shorter adjacent section 63. The bridge member 70 also supports the keyboard 12 when the wrist support assembly 30 is extended away from the keyboard platform 20, the top surface 73 of the bridge member 70 being in the same plane as the top of keyboard platform 20. A top surface 73 of the bridge member 70 may support an antiskid pad 74 to help frictionally support the keyboard 12 adjacent to the wrist support assembly 30.

The preferred keyboard support may also be adjusted to a desired angle relative to the work surface 14. A preferred means for adjusting the angle of the keyboard platform 20 is comprised of a variable height rear support member 80. The rear support member 80 includes an upwardly-extending threaded cylindrical portion 81 and a foot 82. A knob 83, preferably located intermediate between the rear foot 82 and the threaded cylindrical portion 81, allows the user to adjust the height between the back edge 24 and the work surface 14 as desired. An extension member 84 protrudes from the back edge 24 of the keyboard platform 20. The extension member 84 includes a threaded aperture 86 which engages the upwardly-extending threaded cylindrical portion 81. A housing 85 is preferably supported above the extension member 84 to accommodate the upwardly-extended cylindrical member as it protrudes above the top 25 of the keyboard platform 20. The housing 85 also prevents the keyboard 12 from sliding backward on the keyboard platform 20 relative to the wrist support assembly 30.

As suggested by FIG. 3, the preferred keyboard support assembly 10 may be adjusted: (1) in the direction of arrow "A" to support the user's wrist at a desired height relative to the work surface 14, the keyboard 12, or both; (2) in the direction of arrow "B" to accommodate various sized keyboards between the wrist support assembly 30 and the housing 85 and to position the keyboard 12 relative to the wrist support assembly 30; and (3) in the direction of arrow "C" to allow the user to position the keyboard at any desired angle relative to the work surface 14.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An adjustable keyboard support comprising:

a keyboard platform having a substantially flat upper surface for supporting a keyboard above a planar work surface;

means for continuously adjusting the angle of the keyboard platform relative to the planar work surface by adjusting the height between the planar work surface and a back side of the keyboard platform;

a wrist support bar;

means for attaching said wrist support bar to said keyboard platform at a variable distance relative to a front edge thereof, whereby the keyboard platform may accommodate various-sized keyboards; and means for adjusting the height of said wrist support bar relative to the upper surface of the keyboard platform.

2. The adjustable keyboard support of claim 1 wherein the means for adjusting the angle comprises:

an internally threaded aperture located near a back edge of the keyboard platform; and a support member having an externally threaded member having an upper end engaging the internally threaded aperture from a bottom side of said keyboard platform, whereby the threaded member may be adjustably turned into the threaded aperture to vary the height between the work surface and the back edge of the keyboard platform.

3. An adjustable keyboard support comprising:

a rigid keyboard platform having a substantially flat surface for supporting a keyboard above a planar work surface;

adjustable support means, integral with the keyboard platform, for supporting the keyboard platform at a variable angle relative to the planar work surface by adjusting the height between the planar work surface and a back end of the keyboard platform;

a wrist support bar;

variable position attachment means for attaching said wrist support bar to said keyboard platform at a variable distance relative to a front edge thereof; whereby the keyboard platform may accommodate varioussized keyboards; and adjustment means for adjusting the height of said wrist support bar relative to an upper surface of the keyboard platform.

4. The adjustable keyboard support of claim 3 wherein the support means comprises a pair of spaced front support feet located adjacent to the front edge of the keyboard platform.

5. The adjustable keyboard support of claim 4 wherein the support means further comprises:

a variable height rear support foot located adjacent to a rear edge of the keyboard platform, the height of said rear support foot being adjustable to pivot the keyboard platform about the front support feet and thereby vary the angle of the keyboard platform relative to the planar work surface.

6. The adjustable keyboard support of claim 4 wherein:

the wrist support bar is comprised of a pair of spaced apertures extending vertically therethrough;

each support foot is comprised of an upwardly extending threaded shafts that extends through a corresponding one of said spaced apertures; and the adjustment means is comprised of a pair of knobs, each knob extending through a corresponding one of said apertures, each knob having a shoulder at a bottom end thereof for supporting the wrist support bar thereon, and each knob having a threaded bore extending upward from a bottom end thereof for engaging a corresponding one of the upwardly extending threaded shafts whereby the knobs may be turned to adjust the height of the wrist support bar relative to the planar work surface.

7. The adjustable keyboard support of claim 4 wherein a rear end of the rigid keyboard platform carries a threaded aperture and wherein the rear support foot comprises:

a cylindrical member threaded on an upper end thereof, said threaded upper end engaging the threaded aperture of the rigid keyboard platform; and a knob located on said cylindrical member above a bottom end thereof.

8. The adjustable keyboard support of claim 3 wherein the variable position attachment means comprises:

a pair of rigid support members having a proximate end and a distal end;

a pair of spaced slide channels formed in the keyboard platform, the proximate end of each rigid support member being variably positioned within a corresponding one of said slide channels; and means for attaching the distal end of each rigid member to the wrist support bar, whereby the wrist support bar may be variably positioned relative to the front edge of the keyboard platform.

9. The adjustable keyboard support of claim 8 wherein each rigid support member is comprised of an elongate rod configured to form a U-shaped portion at the proximate end thereof, said U-shaped portion being defined by a primary segment extending from the proximate end to the distal end and a shorter secondary segment: extending from the proximate end substantially parallel to and partially along the length of the primary segment.

10. The adjustable keyboard support of claim 9 further comprising:

a bridge member positioned between the primary segment and the shorter secondary segment to provide increased rigidity.

* * * * *